United States Patent [19]

Brunnberg

[11] 4,014,655

[45] Mar. 29, 1977

[54] PLANT FOR CONTINUOUS PRODUCTION OF EXPLOSIVE CONTAINING EXPLOSIVE OIL

[75] Inventor: Bernt Brunnberg, Nora, Sweden

[73] Assignee: Nitro Nobel A.B., Gyttorp, Sweden

[22] Filed: Mar. 27, 1975

[21] Appl. No.: 562,662

[30] Foreign Application Priority Data

Apr. 10, 1974 Sweden ..... 7404839

[52] U.S. Cl. ..... 23/266; 23/260; 260/645; 264/3 B; 264/3 C; 149/47; 149/50; 149/60; 149/66; 149/102; 259/DIG. 2; 259/DIG. 8

[51] Int. Cl.[2] ..... C06B 21/00

[58] Field of Search ..... 23/266, 260; 260/645, 260/644, 646; 264/3 B, 3 C; 149/47, 50, 60, 66, 102; 86/1 R; 259/DIG. 2, DIG. 8

[56] References Cited

UNITED STATES PATENTS

| | | | |
|---|---|---|---|
| 2,717,903 | 9/1955 | Ruth | 23/266 X |
| 3,329,540 | 7/1967 | Tsugihashi et al. | 149/66 X |
| 3,667,733 | 6/1972 | Fritsch | 259/DIG. 8 X |

*Primary Examiner*—James H. Tayman, Jr.
*Attorney, Agent, or Firm*—Hane, Baxley & Spiecens

[57] ABSTRACT

An explosive is produced in a continuous process made up of three stages. The first stage is mixing the solid ingredients of the explosive and transporting it to a mixing station. The second stage is emulsifying nitroglycerine and transporting it to the mixing station where the nitroglycerine is separated from the water and combined with other liquid ingredients. The third stage is the mixing stage where the solid and liquid ingredients are mixed or kneaded and formed into suitably-sized explosive units. The mixing station is provided with a mixer having a pair of hoppers in which are deposited the liquid ingredients and the solid ingredients, and which empty into a housing having a pair of rotating mixing screws which mix the liquid and solid ingredients. The liquid ingredients never contact the bearings of the mixing screws. The ratio of liquid to solid ingredients of the explosive may be varied by varying the feeding rate of each.

12 Claims, 5 Drawing Figures

PLANT FOR CONTINUOUS PRODUCTION OF EXPLOSIVE CONTAINING EXPLOSIVE OIL

The present invention relates to a plant for the production of explosive compounds of the dynamite type, in which a liquid phase and a solid phase are mixed in a kneading machine.

BACKGROUND OF THE INVENTION

Previously, explosive oil has been fed in batches to a mixing apparatus with liquid additives such as nitro compounds etc. and nitrocellulose. The time for this mixing usually amounts to 3 – 5 minutes, and the mixed product is called blasting gelatine. To the blasting gelatine are added solid components consisting of salts, such as ammonium nitrate, sodium nitrate, wood meal etc. The mixing time for the admixture of the solid components to the blasting gelatine up to the finished product is usually between 5 and 10 minutes. The total processing time for a batch of explosive is usually between 15 and 20 minutes, including the time for moving and emptying. The sizes of the batches can vary within wide limits at a plant, but normally there are quantities of 400 – 700 kg to a batch. This involves that if an accident should occur, it will have a devastating effect, with consideration to the quantity of explosive. It may also be mentioned that a great number of accidents have also occurred at the above-mentioned manufacture of batches, owing to inter alia the fact that the explosive oil, which is sensitive to initiation, is to be mixed with solid components in a mechanically operated machine. In many cases, these accidents can have been caused by solid metal objects having fallen down into the mixture and having been squeezed between kneading blades and the wall of the vessel. The risk for this is considerable at a discontinuous processing of large quantities of explosive and with a limited time allotted for the manufacture.

SUMMARY OF THE INVENTION

The purpose of the present invention is to eliminate the above-mentioned disadvantages by a mixing of substantially smaller quantities of liquid ingredients and solid ingredients. It is obvious that mixing of smaller batches is uneconomical, and therefore the mixing according to the present invention takes place continuously, three places or spaces separate from each other then being used; a first space for the actual mixing of solid ingredients, a second space for the dosage of explosive oil, and a third space for the mixing or kneading of solid ingredients and explosive oil. According to the invention, the explosive oil is desensitized with water when it is added to the mixing or kneading space. In the mixing space, the explosive oil is separated from the water and is mixed with an additive liquid such as orthonitrotoluene, dinitrotoluene or similar substances, which at the same time can constitute desensitizing agents. The desensitized oil is fed to a kneading machine, to which are also fed solid, ready-mixed ingredients from a separate mixing space. The liquid ingredients are fed to the kneading machine in such a way that they never come into contact with the ends of the kneading machine. The machine contains one or several feeding screws, designed in such a way that the ingredients are vigorously mixed with each other.

Finished explosive can either be fed to collecting vessels of appropriate size, or can be fed to a container with a feeding screw, which has an outlet through which explosive is fed out in an appropriate form for use.

According to the invention, explosive oil and additive liquid is fed in through special funnels containing measuring devices.

The feed of explosive oil, additive liquid and solid ingredients is controlled in such a way that an explosive compound with the composition desired is obtained.

Specific properties of the present invention, which is a plant, are stated in the following claims.

It should be obvious that all of the components comprised in the plant are not only delimited to the plant, but can be used individually in various applications.

BRIEF DESCRIPTION OF THE DRAWING

An embodiment of the present invention will be described in more detail with reference to the accompanying five drawings, in which.

DETAILED DESCRIPTION OF THE INVENTION

Figure 1:
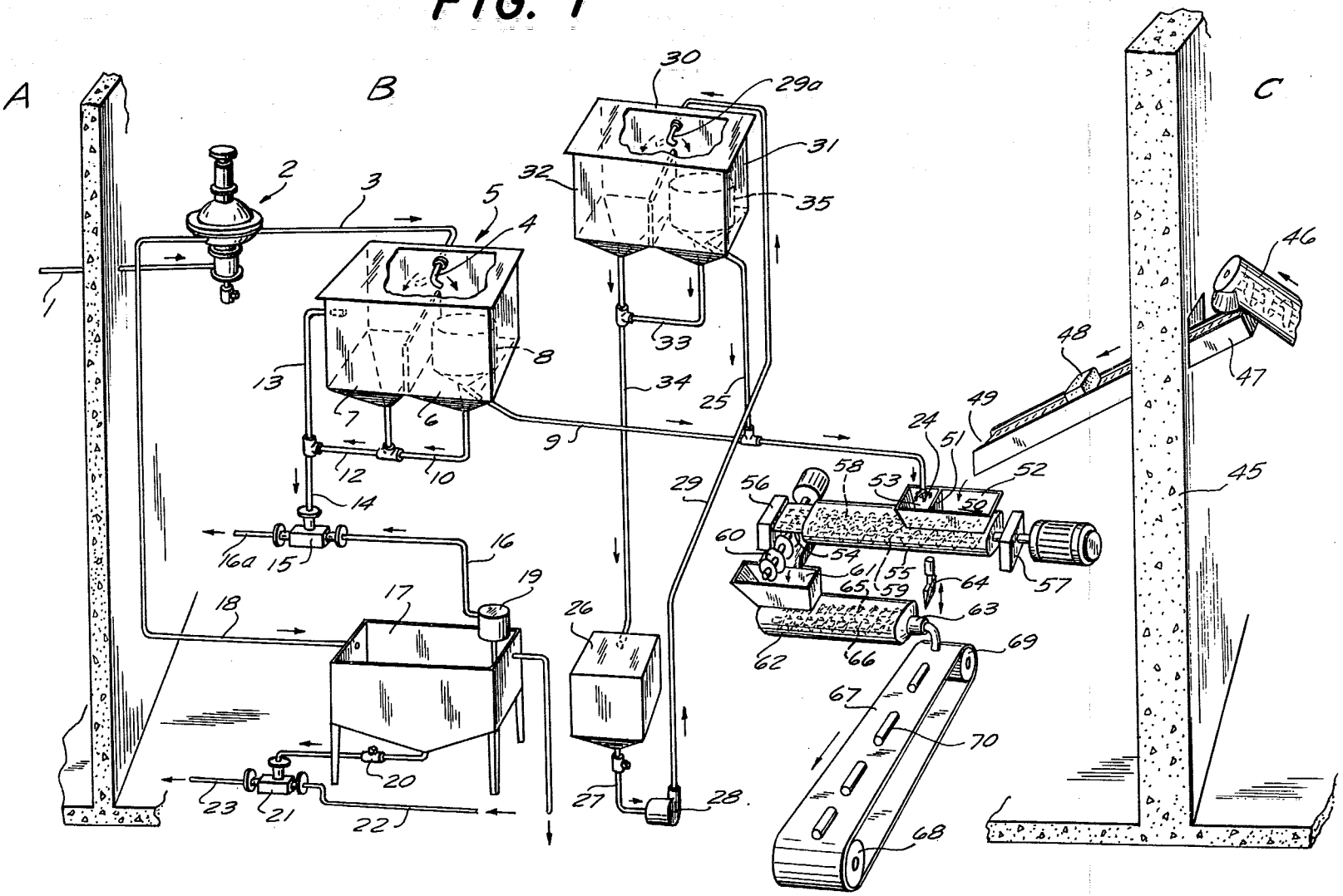
FIG. 1 shows a schematic view of a complete plant for the production of explosive according to the present invention.

The plant according to the present invention contains three spaces, A, B, and C, which are separated from each other. In space A, explosive oil is produced, which is emulsified in water. The emulsion is conveyed to the space B via a pipe 1. The pipe 1 is connected to a device 2 for separation of the explosive oil from the water. The explosive oil can consist of a mixture of nitroglycerine and nitroglycol. The device for separating explosive oil from water can be of any known kind whatsoever. The device for separating the explosive oil has a pipe 3 for feeding explosive oil to a double funnel 5. At its end, the pipe 3 has an adjustable feed pipe 4, which can be put into connection with either the half 6 or the half 7 of the double funnel 5. The funnel half 6 contains a measuring device 8, which is connected to outlet pipe 9. The double funnel 5 has two bottom drains 10 and 12, and a ventilation pipe 13, which drains are connected via a drain pipe 14 to a transportation injector 15.

The transportation injector 15 is connected to a water pipe 16, which supplies water under pressure. The transportation injector 15 is also connected to a return pipe 16a for emulsified explosive oil. The pipe 16 is connected to a water tank 17 via a pump 19. The separating device 2 is also connected to the water tank 17, via a pipe 18. At its bottom, the water tank 17 is provided with a connection 20, by means of which it is connected to an injector 21. The injector 21 is connected to a water supply system by means of a pipe 22. From the injector 21 there is a pipe 23 to the space for the production of emulsified explosive oil. The pipe from the measuring device 8 is provided with a spray nozzle 24, which can spread out the explosive oil over the area desired. Between its ends, the pipe 9 is connected to a pipe 25 for the supply of additive liquid, such as desensitizing agent or nitro compounds such as orthonitrotoluene, dinitrotoluene or the like. Said additive liquid is kept in a tank 26. This tank contains suitable devices for keeping its contents of additive liquid at the temperature desired. Liquid is drawn from the bottom of the tank via a pipe 27 by the pump 28. From the pump 28 there is a feed pipe 29 to a double funnel 30. The pipe 29 has a movable feed pipe 29*a*, which can be set to emerge in either the half 31 or the other half 32 of the double funnel. The double funnel is particularly of the same type as the double funnel 5. The two halves 31 and 32 of the funnel have drains in their bottoms, via the pipes 33 and 34. The pipe 34 returns drained additive liquid to the tank 26. The funnel half 31 contains a measuring device 35, of the same type as the measuring device 8. The measuring device is connected via said pipe 25 to the pipe 9.

Figure 2:
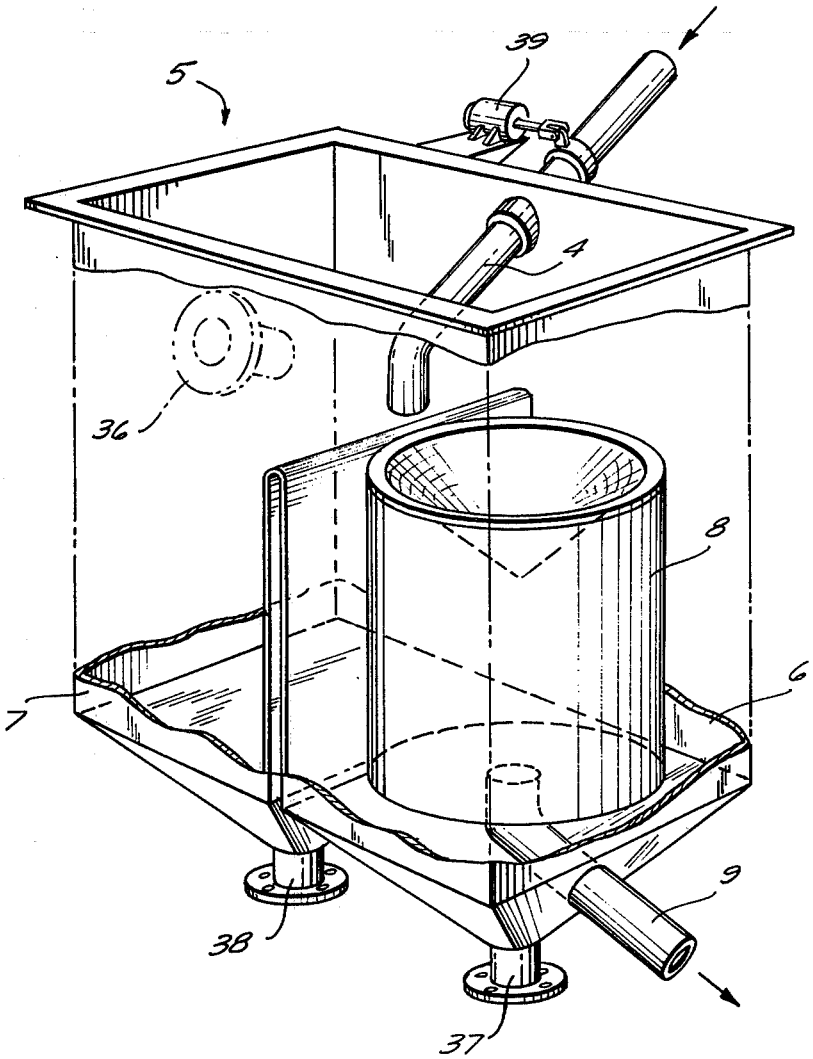
FIG. 2 shows a double funnel, which is used for separation of explosive oil as well as additive liquid.

FIG. 2 shows the characteristics of a double funnel according to the reference designations 5 or 30 in more detail. Thus, FIG. 2 shows the two funnel halves 6 and 7, which contain a measuring device 8 and the pipe 9. The double funnel has a ventilation pipe 36, and each funnel half has a bottom drain 37 and 38, respectively. The feed pipe 4 to one of the two funnel halves is supported in a rotatable fastening device 39.

Figure 3:
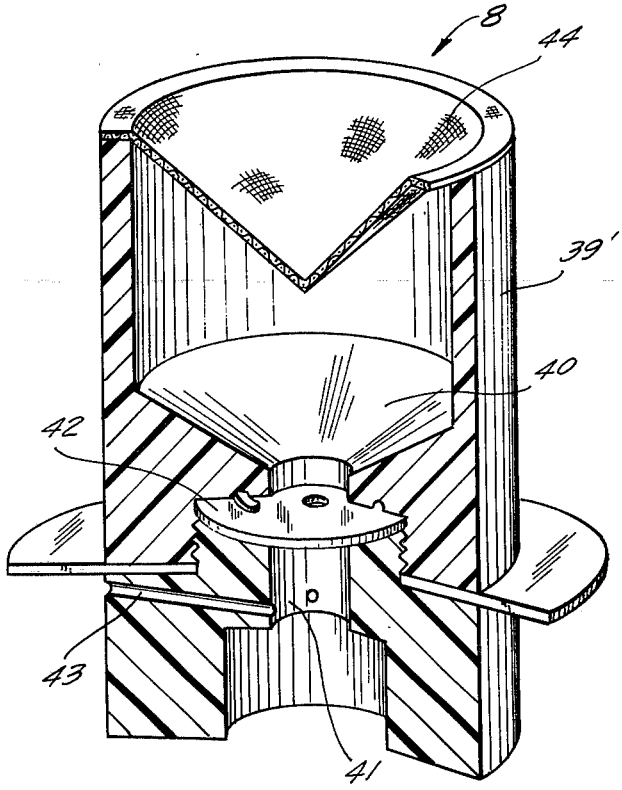
FIG. 3 shows a measuring device comprised in the double funnel according to FIG. 2.
Figure 4:
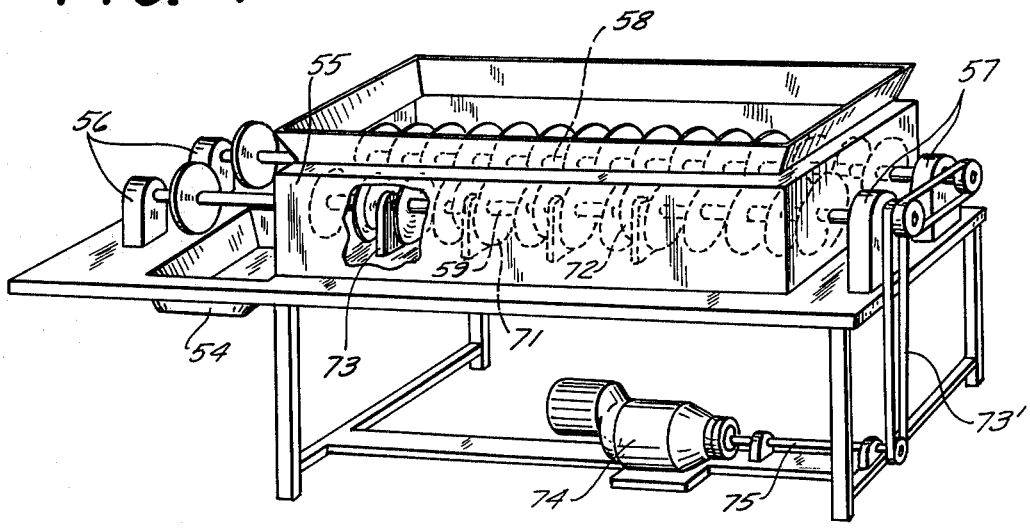
FIG. 4 shows a view of a mixer used.
Figure 5:
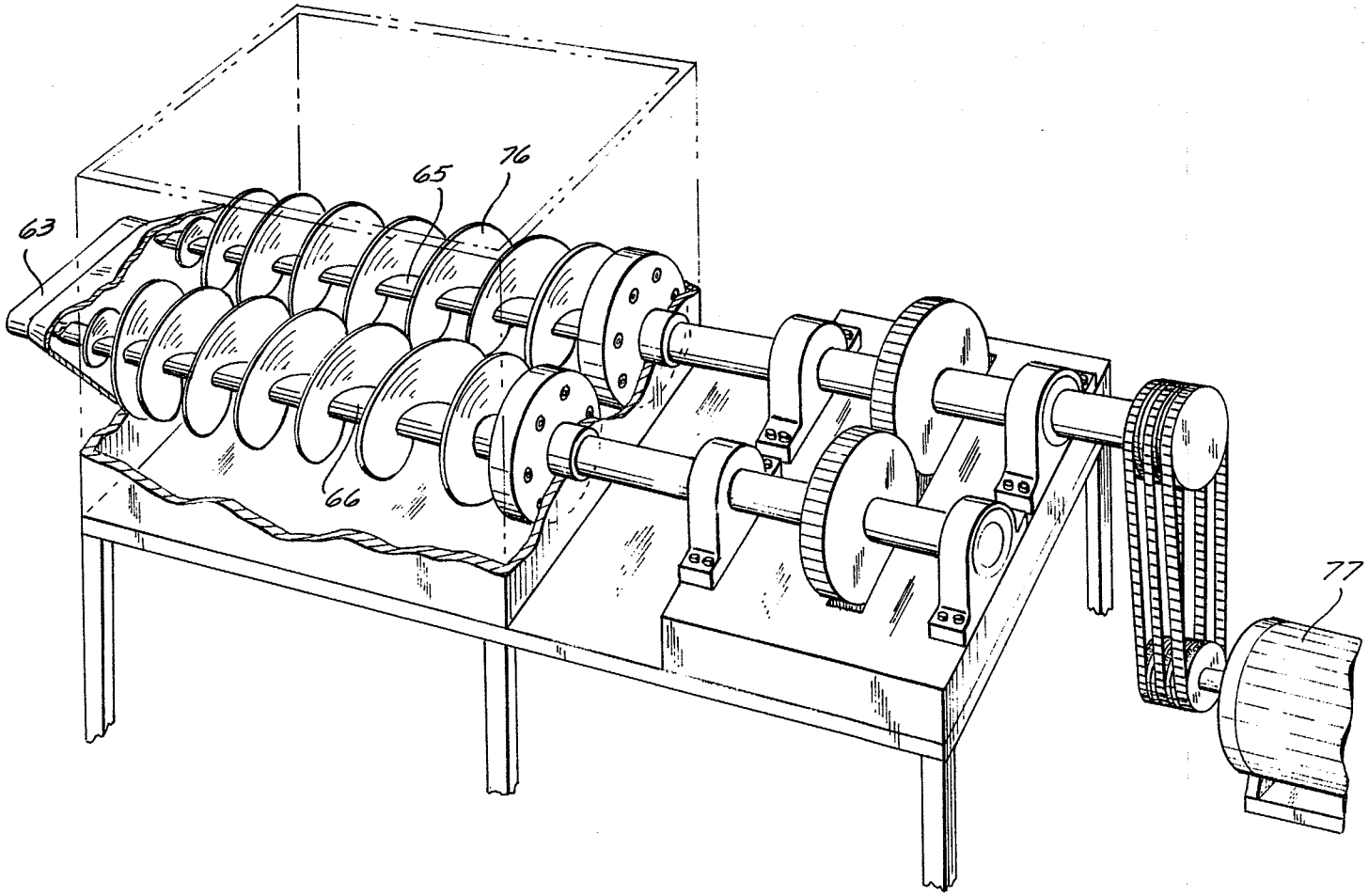
FIG. 5 shows a screw feeder.

The measuring device is of a cylindrical character, and is provided with an upper space, which is open at the top. The space is surrounded by a wall 39'. The space has a conical bottom 40 (see FIG. 3) with a cylindrical drain 41, which is connected to either the pipe 9 or the pipe 25. Said space is covered at the top by a straining cloth 44 made of metal or some other suitable material, which is fastened or applied to the upper edge of the wall 39'. In the cylindrical drain there is a washer 42, particularly made of stainless steel, with a hole in the centre. Further, the drain 41 has a ventilation hole 43. The actual measuring device is appropriately made of plastic, such as polyethylene.

The space B is separated from the space C by means of a concrete wall 45. In space C there is a drying device for nitrocellulose, so that the nitrocellulose particularly obtains a moisture content of 10 – 15%. In said space there are one or several mixers, which can be of the same type as concrete mixers. However, these mixers should be made of rustproof material. With the aid of said mixers, the nitrocellulose and other solid ingredients which are to be included in an explosive of the dynamite type are mixed. Examples of such ingredients are wood meal, ammonium nitrate and sodium nitrate. In such a mixer the solid ingredients are mixed during a time of e.g. 5 – 10 minutes. When the solid ingredients have been mixed, they are passed through a sieve of any appropriate kind whatsoever, for example a brush sieve. After having passed through the sieve, the mixed solid ingredients are fed to a screw conveyor 46, which is connected with a transport channel 47, which goes through the wall 45, and which is provided with a vibration device 48. The transport channel 47 has an outlet end 49, which goes to a mixer 50, and then to one of the intake openings 52 of the mixer. The mixer has a second intake opening 53. The two intake openings, or hoppers, are separated by means of a separating wall 51. The mixer has an outlet opening 54, and consists of a housing 55, particularly made of high-molecular polyethylene. The housing is placed in a sturdy stand, made of e.g. steel. The mixer has supporting devices 56 and 57 for two feeding screws 58 and 59, which are located outside the feeding vessel. Under the outlet opening 54 there is a screw feeder 60 with an intake opening 61, a housing 62 and an outlet opening 63. The housing 62 can be made of the same material as the housing 55, and can be arranged in a stand made of steel. At the outlet opening 63 a cutting member 64 can be arranged, which cuts off the explosive which is fed out into pieces of appropriate size. The screw feeder is provided with two feeding screws 65 and 66. In front of the outlet opening 63 an endless belt 67 is arranged, which is supported on two rollers 68 and 69. Portioned units of explosive have been given the reference designation 70.

The mixer 50 has two feeding screws 58 and 59, each of which has a number of screw segments 71 in its longitudinal direction, which are separated from each other by separating walls 72. At each screw segment junction there are also fixed, radial journals or pins 73. The two screws have a speed of 15–35 r.p.m. and are driven by a common motor 74 with speed control. The motor 74 is connected via a transmission 73' with the screws 58 and 59. The shafts of the two screws are provided with screening plates in front of the supports with outlet openings.

As previously mentioned, the screw feeder has two screws 65 and 66, with spiral blades 76. The two screws are driven by a motor 77.

All of the devices in the three spaces A, B and C can be remote-controlled, and can also be remotely supervised with the aid of TV cameras.

The plant described functions in the following way.

Via the pipe 1, explosive oil emulsion is fed to the separating device 2. This device feeds explosive oil via the pipe 3 to the funnel half 6, where the explosive oil is collected in the measuring device 8, from where it is fed via the pipe 9 to the spray nozzle 24. On the way to the spray nozzle, additive liquid is fed to the explosive oil via the pipe 25. The mixing of the explosive oil and the additive liquid takes place at the junction between the pipes 25 and 9. The desired quantity of additive liquid is fed to the funnel half 31 by means of the pump 28, and fills the measuring device 35.

In space C, as previously mentioned, a mixture of solid ingredients is prepared. The mixture is transferred to a screw feeder, which is set at an appropriate speed. The screw feeder delivers the mixture to a transport channel 47. The mixture is fed to the right inlet opening of a mixer 50. The bottom of the mixer will thereby be provided with the solid phase of the explosive. From the spray nozzle 24, explosive oil is sprayed over the solid phase through the inlet opening 53. It should be noted that the explosive oil cannot come into contact with the screw shaft bearings. Nearest to the right bearing there is only the solid phase for the explosive. The screws in the mixer, as well as the mixer itself, have such properties that the best possible mixing of the solid phase and the liquid is obtained. During the mixing, the mixture is moved rearwards intermittently, so that as good mixing as possible is obtained. The outlet opening 54 of the mixer is completely separated from the shaft bearing 56. From the opening, explosive can be emptied into containers of the size desired, or can be transferred to a feeding screw 60, which has an inlet opening 61 and an outlet opening 63. By means of the feeding screw, a string of the explosive can be fed out through the opening 63. By means of a cutting member 64, the explosive string which is fed out can be cut up into the lengths desired.

When using the plant described, the quantity of explosive oil can be reduced to a maximum of 5 kg, which involves that if, contrary to all expectations, an accident should occur, its effect will be considerably less than when previously known procedures are used. During the manufacture, the space B can contain a maximum of 100 kg of finished explosive.

By adjusting the feeding speeds for the solid and the liquid ingredients, the composition desired of the finished explosive can be obtained.

If the feed pipes 4 and 29*a* are set at the left funnel halves 7 and, 32, respectively, liquid that has been fed is conveyed off to the transportation injector 15, and tank 26, respectively. The transportation injector receives explosive oil, and this is emulsified in the transportation injector 15, due to the feed of water. The emulsion is returned to the emulsion store in space A via a pipe 16*a*.

The separating device 2 removes the water, which is conveyed to the tank 17 via the pipe 18.

As previously mentioned, the individual parts of the plant can be used separately, and thus do not have applications only in the combination shown in FIG. 1.

I claim:

1. An apparatus for continuously producing explosive made up of a mixture of explosive liquid and solid ingredients comprising: a first station having means for storing emulsified explosive liquid, and first means for transporting said explosive liquid to a second station; a second station for mixing the explosive liquid and the solid ingredients; and a third station having a first means for mixing said solid ingredients, and second means for transporting said mixed solid ingredients from said third station to said second station, said second station being positioned between said first and third stations; said second station comprising means for separating said explosive liquid from the water contained therein, a second means for mixing said solid ingredients with said dewatered explosive liquid, said second means for mixing having a first inlet for receiving and storing said solid ingredients after having been transported to said second station by said second means for transporting of said third station, and a second inlet spaced from said first inlet toward said first station for receiving and storing therein said dewatered explosive liquid delivered by said first means for transporting of said first station, said second means for mixing having a wall separating said first and second inlets so that said dewatered explosive liquid and said solid ingredients do not contact each other prior to being mixed, said second means for mixing further having a mixer mounted below said first and second inlets for mixing said solid ingredients and said explosive liquid delivered thereto from said first and second inlets, and said second station further comprising third means for transporting connected to said first and second means for transporting of said first and third stations, respectively, so that the dewatered explosive liquid and the solid ingredients may be supplied to said second and first inlets, respectively.

2. The apparatus according to claim 1, wherein said third means for transporting comprises a first measuring device for feeding said explosive liquid in predetermined amounts to said second inlet, first conduit means connecting said measuring device with said second inlet, said measuring device being in fluid communication with said means for separating said explosive liquid from the water contained therein so that after the explosive liquid has been dewatered it is sent to said measuring device for transport to said second inlet.

3. The apparatus according to claim 2, wherein said third means for transporting further comprises a double-funnel having a first funnel and a second funnel having said measuring device mounted therein, a water storage tank having a pump associated therewith, a second conduit means having a first end in fluid communication with the bottom of said first and second funnels and a second end, and third conduit means having a first end in fluid communication with said pump and water storage tank and a second end in fluid communication with said second end of said second conduit means, and a fourth conduit means having a first end in fluid communication with said second ends of said second and third conduit means and a second end in fluid communication with said means for storing emulsified explosive liquid, whereby the dewatered explosive liquid exiting from said bottoms of said first and second funnels are rerouted back to said means for storing emulsified explosive liquid via said second and fourth conduit means and mixed with water from said water storage tank via said third conduit means.

4. The apparatus according to claim 1, wherein said third means for transporting further comprises a fifth conduit means having a first end in fluid communication with a source of water and a second end in fluid communication with said means for storing emulsified explosive liquid, whereby explosive liquid is emulsified and stored in said means for storing emulsified explosive liquid.

5. The apparatus according to claim 2, wherein said third means for transporting further comprises means for mixing additive liquid with said dewatered explosive liquid, said means for mixing additive liquid comprising a storage tank for said additive liquid, means for feeding said additive liquid from said storage tank for said additive liquid to said first conduit means, and fifth conduit means having a first end in fluid communication with said means for feeding said additive liquid and a second end in fluid communication with said storage tank for additive liquid, whereby said additive liquid is supplied to said means for feeding from said storage tank via said fifth conduit means.

6. The apparatus according to claim 5, wherein said means for feeding comprises a double-funnel having a first funnel having a second measuring device mounted therein and a second funnel, said first end of said fifth conduit means being in fluid communication alternately with one of said first and second funnels.

7. The apparatus according to claim 6, wherein said third means for transporting further comprises a sixth conduit means having a first end in fluid communication with the bottom of said second funnel and a second end in fluid communication with said storage tank for additive liquid, and said means for feeding having a seventh conduit means having a first end in fluid communication with said second measuring device and a second end in fluid communication with said first conduit means, whereby said additive liquid is mixed with said dewatered explosive liquid via said seventh conduit means.

8. The apparatus according to claim 1, wherein said mixer further comprises a housing, a first mixing screw and a second mixing screw rotatably mounted in said housing, said housing having an outlet end by which the mixture of explosive liquid and solid ingredients are exited, and means for collecting said mixture of explosive liquid and solid ingredients.

9. The apparatus according to claim 8, wherein said mixer further comprises a first hopper and a second hopper, said first and second hoppers constituting said first and second inlets, said first and second hoppers being separated in fluid-tight relation with each other by said wall and mounted above said housing and in communication therewith so that said explosive liquid and said solid ingredients supplied to said hoppers may enter said housing and be mixed together by said first and second mixing screws.

10. The apparatus according to claim 8, wherein said means for collecting comprises a first conveying means mounted at said outlet end of said housing, means for forming said mixture of solid ingredients and explosive liquid into equally-sized units, and a second means for conveying said equally-sized units from said means for forming.

11. The apparatus according to claim 9, wherein said mixer further comprises a first supporting device for said first mixing screw and a second supporting device for said second mixing screw, said first and second supporting devices being mounted beyond opposite ends of said housing, whereby said explosive liquid and said solid ingredients injected into said housing do not contact said first and second supporting devices.

12. The apparatus according to claim 1, wherein said first station comprises a first wall for separating said first station from said second station, and said third station comprises a second wall for separating said third station from said second station.

* * * * *